United States Patent [19]

Miller

[11] Patent Number: 4,576,376

[45] Date of Patent: Mar. 18, 1986

[54] EXERCISING APPARATUS

[76] Inventor: Paul H. Miller, 8 Pheasant Run Dr., Batesville, Ind. 47006

[21] Appl. No.: 674,184

[22] Filed: Nov. 23, 1984

[51] Int. Cl.[4] ..... A63B 23/06

[52] U.S. Cl. ..... 272/69; 272/DIG. 6

[58] Field of Search ..... 272/69, 71, DIG. 6; 119/29; 4/496; 128/65

[56] References Cited

U.S. PATENT DOCUMENTS 3,592,466 7/1971 Parsons ..... 272/69

FOREIGN PATENT DOCUMENTS 681070 2/1964 Canada ..... 272/71

121186 10/1984 European Pat. Off. ..... 272/73

2653935 6/1978 Fed. Rep. of Germany ..... 272/71

*Primary Examiner*—Richard J. Apley

*Assistant Examiner*—Kathleen D'Arrigo

*Attorney, Agent, or Firm*—Woodard, Weikart, Emhardt and Naughton

[57] ABSTRACT

A treadmill is provided in a tank in which there is sufficient water to provide considerable buoyancy to a person walking or running on the treadmill. The treadmill operates a water pump, and means are provided to restrict the pump output to the extent desired to provide the desired load or resistance to movement by the treadmill.

8 Claims, 1 Drawing Figure

EXERCISING APPARATUS

BACKGROUND OF THE INVENTION

1. Field of the Invention

This invention relates generally to exercise equipment, and more particularly to apparatus enabling a jogging type of exercise without some traumatic effects which can result from conventional jogging.

2. Description of the Prior Art

Jogging is a very natural form of exercise. In some cases, it is done by persons who like jogging. Others feel compelled to do it. On some surfaces and in some conditions, it can be detrimental to the health, and subject the jogger to possible accident. Examples of detrimental environmental conditions are irregular or slick ground surfaces, darkness, extreme heat, and extreme cold. Some personal physical conditions to which jogging can be detrimental are cases of weakness of bones, joints and circulatory system. Therefore, it is an object of the present invention to provide an exercising device which will preserve many of the benefits of jogging, and yet avoid the detrimental effects of the above-mentioned envrionmental and physical conditions.

SUMMARY OF THE INVENTION

Described briefly, and according to a typical embodiment of the present invention, a treadmill is provided in a tank in which there is sufficient water to provide considerable bouyancy to a person walking or running on the treadmill. The treadmill operates a water pump, and means are provided to restrict the pump output to the extent desired to provide the desired load or resistance to movement by the treadmill.

BRIEF DESCRIPTION OF THE DRAWINGS

The single FIGURE (FIG. 1) of drawing shows a longitudinal section through a tank with a treadmill submerged therein according to a typical embodiment of the present invention.

DESCRIPTION OF THE PREFERRED EMBODIMENT

Figure 1:
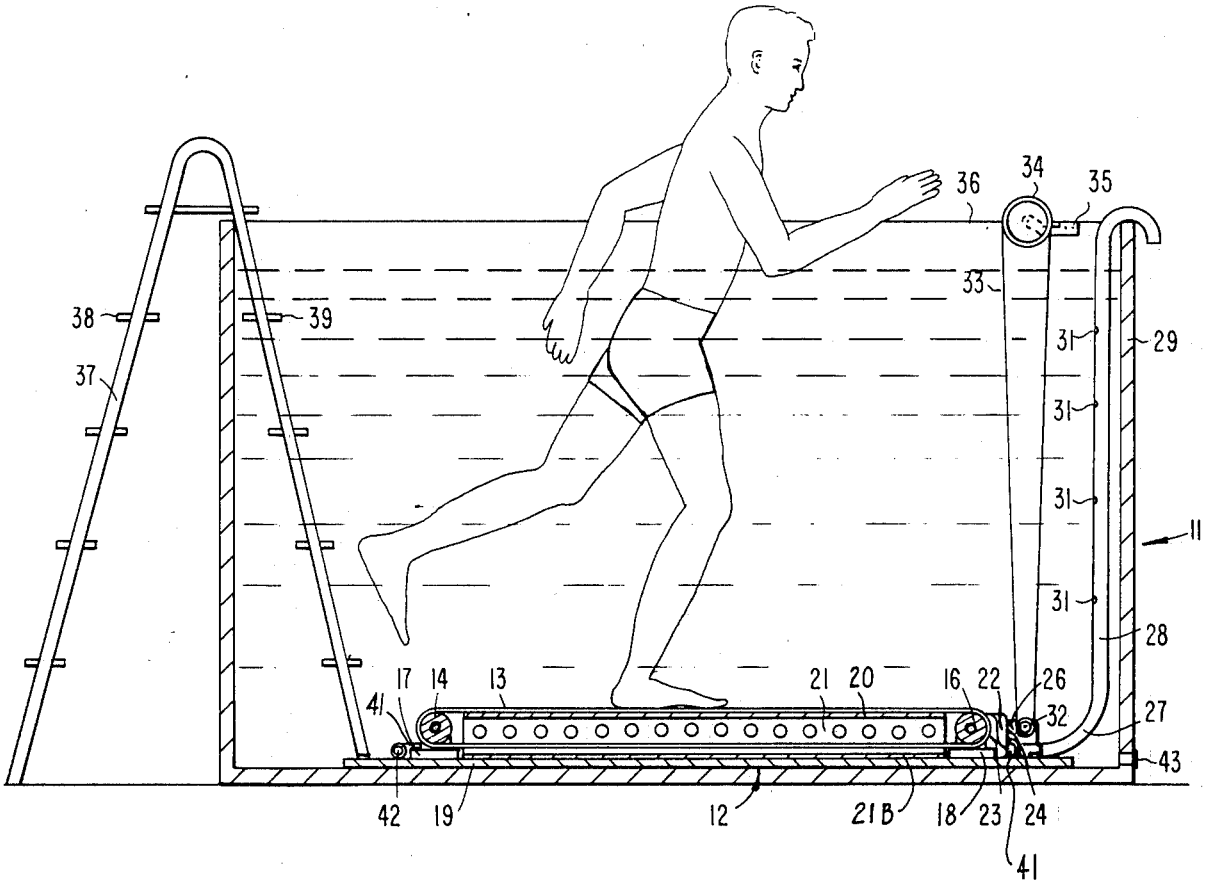

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the open-topped tank 11 has a treadmill assembly 12 resting on the bottom of the tank. This assembly includes an endless belt 13 stretched between and tightly engaging pulleys or rollers 14 and 16 at opposite ends thereof and which are secured on shafts supported in pillow blocks 17 and 18. These blocks are mounted to the base frame 19 of the treadmill assembly, which rests on the bottom of the tank. The frame position in the bottom of the tank is controlled, as will be seen, so that it cannot creep toward either end or either side of the tank, while in use.

The upper flight of the endless belt can be supported on a series of rollers, but may also be mounted on a fairly rigid plate 20 which is supported at its opposite sides on opposite sides of the belt by walls 21 with inwardly turned bottom flanges 21B mounted on the frame 19, the plate 20 extending across the tank between the upper and lower flights of the belt. This plate can be perforated or provided with a low-friction top surface, or both, in order to enable the upper flight of the belt to slide easily on top of it, even with the weight of the jogger supported on it.

A pump 22 is mounted to frame 12 at one end of the treadmill and a gear drive is provided between it and the roller 16 in the housing 23. The pump has an output port 24 to which a valve assembly 26 is connected. A discharge line 27 is connected to the valve assembly and has a stand pipe 28 extending up therefrom and hooked over the top of the front wall 29 of the tank. This stand pipe has apertures 31 therein at vertically spaced points and which are directed to the rear toward the rear of the tank.

The valve assembly has a pulley 32 on the valve operator shaft and which is connected by a belt 33 to a control wheel 34 mounted to a bracket 35 attached to the sidewall 36 of the tank. The handwheel is accessible to the jogger to adjust the amount of opening of the valve.

A ladder 37 is provided at the rear of the tank and includes the rungs 38 thereon by which the jogger climbs to the top of the ladder, and the rungs 39 by which the jogger descends into the tank and onto the treadmill. In the event that the frame 12 is not affixed to the floor of the tank by clamps or otherwise, the combination of the discharge pipe 27 and stand pipe 28 at the front end, and the ladder at the rear end, serve to assist in maintaining the correct position of the treadmill frame 19 in the tank and avoid it moving forward or rearward. It is laterally confined by the sides of the tank, but is not likely to move sideways anyway.

The pump inlet is connected to a pipe 41 which extends to the rear of the frame 19 and has an inlet 42 therein.

The tank may be four to six feet long, two to three feet wide, and three to five feet high, depending upon the room space available, the amount of freedom of movement of the jogger which is desired, and the depth of water needed to provide the buoyancy capability which is desired.

In operation, the jogger enters the tank on the ladder, and steps onto the treadmill. He or she starts a walking type of motion on the treadmill, while holding onto the front wall or side walls of the tank, to maintain the jogger's position in the tank, whereupon the treadmill belt will begin to move. If the resistance is not sufficient for the ability of the jogger, the handwheel 34 can be moved to adjust the resistance imparted by the pump discharge valve assembly 26. The water which is delivered through the valve to the stand pipe is discharged through the orifices 31 and thereby directed rearwardly in the tank. The water return to the pump is taken from the inlet 42 adjacent the rear of the tank, back to the pump.

With the passage of time, as the jogger tires, the wheel 34 can be turned to change the valve setting, as desired, to reduce the load on the treadmill.

The amount of water in the tank can be selected to best suit the user's needs. It can be filled with a hose and drained from the drain opening at plug 43, or whatever other manner is desired. It can also be heated, if desired for comfort. Such additional features as may be desirable to an individual user, can be readily incorporated.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An exercising apparatus comprising an open topped tank of sufficient size for entry of an individual to exercise therein:

a treadmill located in said tank;

a pump coupled to said treadmill and operable by said treadmill to pump a fluid in said tank in response to operation of the treadmill by an individual exercising in the tank.

2. The apparatus of claim 1 and further comprising:

valve means associated with said pump to control the load on said pump.

3. The apparatus of claim 2 and further comprising:

a discharge pipe connected to the output of said pump and including a plurality of outlets at various levels above the floor of said tank to discharge into said tank.

4. The apparatus of claim 3 wherein:

said discharge pipe is a stand pipe at the front wall of the tank and connected to the front wall of the tank, said outlets being directed toward the rear of the tank.

5. The apparatus of claim 4 and further comprising:

a pump inlet conduit, said inlet conduit having an inlet opening near the rear of the tank whereby fluid from the tank can be pumped from the rear toward the front and discharged again toward the rear of the tank.

6. The apparatus of claim 5 and further comprising:

ladder means at the rear of the tank and including a portion with steps outside the tank and a portion with steps inside the tank, said ladder portion means with steps inside the tank being connected to said treadmill and cooperating with said pump discharge pipe to maintain the front-to-rear location of the treadmill in the tank.

7. The apparatus of claim 2 and further comprising:

control means above the bottom of said tank and including a control member operatively connected to said valve means, said control member being located accessible to and manually operable by the exercising individual to facilitate changing the resistance of the pump to pumping action imparted thereto by the treadmill.

8. The apparatus of claim 7 and further comprising:

water contained in said tank and up to a level within three feet above the bottom of said tank and providing bouyancy for a person in said tank;

said control member being at a level above the surface of the water to facilitate the operation thereof by the person in the tank using the treadmill.

* * * * *